United States Patent [19]

Ohyabu et al.

[11] Patent Number: 4,966,356

[45] Date of Patent: Oct. 30, 1990

[54] APPARATUS FOR SELECTIVELY FEEDING CUT SHEETS IN A RECORDING MACHINE

[75] Inventors: Keiji Ohyabu, Tokyo; Shinichi Watarai; Hideaki Sano, both of Yokohama, all of Japan

[73] Assignee: Fujitsu Limited, Kanagawa, Japan

[21] Appl. No.: 249,655

[22] Filed: Sep. 27, 1988

[30] Foreign Application Priority Data

| | | | |
|---|---|---|---|
| Sep. 30, 1987 | [JP] | Japan | 62-243621 |
| Oct. 8, 1987 | [JP] | Japan | 62-252524 |
| Mar. 11, 1988 | [JP] | Japan | 63-57545 |

[51] Int. Cl.[5] ..... B65H 3/44

[52] U.S. Cl. ..... 271/9; 271/127; 271/164

[58] Field of Search ..... 271/9, 127, 164, 171

[56] References Cited

U.S. PATENT DOCUMENTS

| | | | |
|---|---|---|---|
| 4,530,494 | 7/1985 | Saitoh | 271/164 X |
| 4,605,215 | 8/1986 | Hyltoft | 271/9 |
| 4,610,445 | 9/1986 | Schneider | 271/171 X |
| 4,754,960 | 7/1988 | Muller | 271/9 |

FOREIGN PATENT DOCUMENTS

| | | | |
|---|---|---|---|
| 0139426 | 5/1985 | European Pat. Off. . | |
| 102729 | 6/1984 | Japan | 271/171 |
| 207335 | 11/1984 | Japan | 271/171 |
| 262737 | 12/1985 | Japan | 271/171 |

*Primary Examiner*—Richard A. Schacher
*Attorney, Agent, or Firm*—Staas & Halsey

[57] ABSTRACT

A sheet feed apparatus of a recording apparatus, for feeding a sheet one-by-one from a stack of cut sheets, includes cassettes which are stacked one above the other. Each cassette has a common sheet sub-passage passing through the cassette from bottom to top. The sub-passages are aligned to form a common sheet feed passage which passes through the stack of the cassettes from bottom to top when all the cassettes are set in a normal position within the recording apparatus. Sheet feed passages formed in the cassettes are disposed end-to-end.

22 Claims, 8 Drawing Sheets

| ON/OF STATE OF MICROSWITCH | | | ANALOG VOLTAGE $v_s$ (V) | ANALOG VOLTAGE $v_{in}$ (V) | DIGITAL SIGNAL SiDT |
|---|---|---|---|---|---|
| SW1 | SW2 | SW3 | | | |
| ON | ON | ON | 0 | 0 | "00" |
| OFF | ON | ON | 0.7 | 0.35 | "23" or "24" |
| ON | OFF | ON | 1.4 | 0.7 | "37" or "38" |
| OFF | OFF | ON | 2.1 | 1.05 | "6B" or "6C" |
| ON | ON | OFF | 2.8 | 1.4 | "8F" or "9D" |
| OFF | ON | OFF | 3.5 | 1.75 | "B3" or "B4" |
| ON | OFF | OFF | 4.2 | 2.1 | "D7" or "D8" |
| OFF | OFF | OFF | 4.9 | 2.45 | "FA" or "FB" |

APPARATUS FOR SELECTIVELY FEEDING CUT SHEETS IN A RECORDING MACHINE

BACKGROUND OF THE INVENTION

1. Field of the Invention

The present invention relates to a sheet feed device for feeding a recording sheet in cut form, such as sheets of paper, to an image transferring station or a printing station in a recording machine. The invention also relates to a sheet feed device wherein stacked recording sheets of different types, such as different sizes and sheet quality, are held in corresponding cassettes and fed selectively one sheet at a time to an image transferring or a printing station.

2. Description of the Related Art

A typical example of a recording machine to which the present invention relates is a laser electrophotographic recording machine. In such a recording machine, a photoconductive medium formed on a surface of a drum is charged to a substantially uniform potential to sensitize the surface thereof. The charged portion of the photoconductive surface is exposed to a light image of an original document to be reproduced. This records an electrostatic latent image on the photoconductive medium corresponding to the information areas contained within the original document. Thereafter, the latent image is developed by bringing a developer material into contact therewith. This forms a toner powder image on the photoconductive medium which is subsequently transferred to a recording sheet. Finally, the recording sheet is heated to permanently affix the toner powder image on the recording sheet.

Generally, the recording sheet used in the recording machine is of a ribbon-like continuous sheet type of a single size, or a cut sheet type having various sizes. In the present invention, the recording sheet of cut sheet type is used, and hereinafter, is simply referred to as a sheet. The sheets of one type in size and quality are held stacked in alignment in one cassette-like sheet holding means (hereinafter referred to as a cassette). Usually, a plurality of cassettes are stacked one above another, forwardly projectable in or from supporting means such as shelves or rails fixed to a frame. Each cassette has a signal actuator for signifying the sheet type for the sheets held therein.

FIG. 1 and FIG. 2 are schematic diagrams illustrating the arrangement of known sheet feed devices. In the apparatus of FIG. 1 cassettes 101 and 102 are disposed forwardly projecting out of an apparatus housing 103, thus occupying floor space in the office when installed. A sheet delivered from the cassette 101 is fed through a transfer passage 104, and a sheet delivered from the cassette 102 is fed through a feed passage 105. Both sheets are fed to an image transfer station 109 in succession where a toner image formed on a photoconductive drum 106 is transferred onto the sheets by an image transfer member 107. Thereafter, each sheet is fed through a passage 110 (shown by an arrow) to an image fixer 108 for fixing the transferred image on the sheets. The surface of the drum 106 is electrically discharged and cleaned by a discharger (not shown) after image transfer is completed.

In the apparatus of FIG. 2, cassettes 111 and 112 are stacked one above another at a lower portion of a housing 113 of the recording machine. A sheet delivered from the cassette 111 is fed through a feed passage 114, and a sheet delivered from a cassette 112 is fed through a feed passage 115. Through a pair of drive rollers 125 and a conveying passage 122, both sheets are respectively conveyed to an image transfer station 119 where a toner image formed on a photoconductive drum 116 is transferred onto the sheet by an image transfer member 117. Thereafter, the sheet is fed through the conveying passage 122 (indicated by an arrow) to an image fixer 118 for fixing the transferred image.

A manual feed passage 123 is disposed through the wall at the side F of the housing 113, facing the feed rollers 125. The surface of the drum 116 is electrically discharged and cleaned by a discharger (not shown) after image transfer is completed. A rectangular structure 120, shown by broken lines, represents a converging mechanism wherein the two feed passages 114 and 115 are joined to a common transfer passage 121 through which the sheets are delivered from the cassettes 111 and 112 to the conveying passage 122. Naturally, the rectangular structure 120 prohibits loading and unloading of the cassettes 111 and 112 from the side F of the housing 113. Thus, loading and unloading operations must be performed from the opposite side B. If a sheet is fed manually through the manual feed passage 123 and becomes jammed in the cassettes 111 or 122, the jammed sheet or sheets must be removed by opening various portions of the housing 113. This is because sheet jamming tends to occur in the vicinity of a portion of the relevant cassette where a sheet is delivered from the cassette (namely from the side F). The operation to remove a jammed sheet and resume the recording operation is not easy and is usually a time consuming matter. In order to perform the manual sheet feed operation and the jammed sheet removal operation, an additional area of floor space is required for an operator in front of the side F. Thus, two areas of floor space for operation at both sides F and B of the housing 113 must be maintained in the office, thereby restricting freedom of placement of the apparatus in the office. Moreover, the rectangular structure 120 provides the recording apparatus with an adverse effect on space-saving in an office, which is an important characteristic of an office machine. A need exists to reduce restrictions on the operating side for loading and unloading sheets to or from the cassettes.

Another problem associated with known recording apparatuses relates to the indicators used to indicate the sheet type of a particular cassette. For instance, in a known sheet feed means, an actuator of a fixed type indicates only for a single sheet type which is peculiar to the cassette. As the result, a cassette specified to receive sheets of a particular type cannot be used as a cassette for receiving sheets of a different sheet type. To enhance the freedom of use of the cassettes, it would be desirable to have the actuator manually changed by an operator or automatically changed by a controller of the apparatus to meet the requirements of each use.

SUMMARY OF THE INVENTION

An object of the present invention is to eliminate the above-described defects of a recording sheet feed means.

Another object of the present invention is to provide a recording apparatus with a single operation side for supplementing sheets to the relevant cassette and disposing of jammed sheets, if any, with a structure which enables the cassettes to be drawn from the side where the sheet delivering outlet is disposed in the relevant cassette.

Still another object of the present invention is to provide a cassette having a manually or automatically changeable sensor for indicating different sheet types.

In one embodiment of the invention, a sheet feed apparatus for a recording machine which records an image on a sheet includes a plurality of sheet holding means, stackable one above the other, each holding a plurality of sheets stacked in a pile therein, support means for supporting the plurality of sheet holding means alternatively at a predetermined normal position and in an forwardly drawn position, each of the sheet holding means including a sheet feed passage within each sheet holding means for passing sheets fed from said pile of said sheets, a sheet feed sub-passage penetrating each said sheet holding means from the bottom to the top of said sheet holding means, all said feed sub-passages being aligned to form a common sheet feed passage when all of said plurality of sheet holding means are set at said normal position in said supporting means, said common sheet feed passage passing said sheets fed from any of said sheet feed sub-passages.

The features and advantages will be more clearly provided by the following description of the present invention and claims with reference to the following drawings, where like reference numerals represent like parts throughout.

DETAILED DESCRIPTION OF THE PREFERRED EMBODIMENTS

Figure 3:
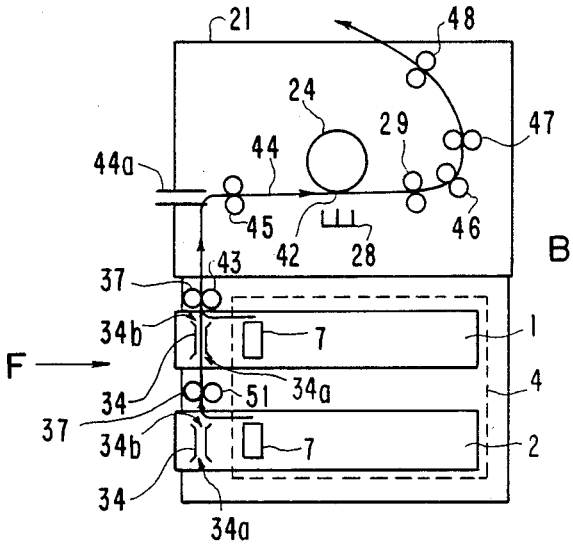
FIG. 3 is a schematic diagram illustrating a sheet feed device according to the present invention.

FIG. 3 schematically illustrates a sheet feed device 5 according to the present invention. The device includes two sheet cassettes 1 and 2 arranged one above another, supporting means 4 for supporting the cassettes 1 and 2 in a forwardly drawable disposition inside an apparatus housing 21, and sheet feed drive rollers 43 and 51 secured to the supporting means 4. Each cassette 1 and 2 has an individual sheet feed sub-passage or through-passage 34 (hereinafter, simply referred to as a sub-passage) which is disposed at a forward side thereof and which passes through either cassette from a bottom side to a top side thereof. A follower roller 37 is disposed in an upper portion of each cassette 1 and 2.

The cassettes 1 and 2 are set in the supporting means 4 at a predetermined position, which is to be referred to hereinafter as "the normal position", such that all of the sub-passages 34 of the cassettes 1 and 2 are aligned to form a composite common sheet feed passage which includes all of the sub-passages 34. Thus, the composite common sheet feed passage is not of one body structure, but is a composite of sub-passages which can be moved into and out of the composite sheet.

The follower rollers 37 form respective pairs of sheet feed rollers in combination with drive rollers 43 and 51. Each sub-passage 34 has an outlet 34*a* and an inlet 34*b*, and has a side-opened opening which faces to the back side of the cassette 1 and 2.

Each cassette 1 and 2 has a guide plate (not shown in FIG. 3) adjacent to the sub-passage 34. Along a curved surface of the guide plate, an individual sheet feed passage 6 (shown in FIG. 6) is formed, through which the sheets stacked in each cassette 1 or 2 is advanced one sheet at a time. Thereafter, the sheets change their feed direction upwardly, entering a composite common sheet passage 3, and are discharged out of the sheet feed device 5 from the outlet 34*a* of the upper cassette 1. Each discharged sheet is conveyed through a conveying passage 44 (shown by a directional arrow) by means of pairs of drive rollers 45, 46, 47 and 48. During passage through the conveying passage 44, an image is developed on a surface of a photoconductive drum 24 and is thus transferred onto the sheet by an image transfer means 28 at the image transfer station 42. The image is fixed on the sheet by an image fixer 29. Then, the recorded sheets are discharged outside the apparatus.

With the above-described configuration of the sheet feed device, the cassettes 1 and 2 are drawable outwardly so as to be drawn out of the housing 21 toward the side F of the recording apparatus. This outward movement is possible since there is no uni-body structure for guiding and feeding the delivered sheet from each cassette, such as what is found in the known devices.

Meanwhile, each of the above-described cassettes 1 and 2 has an improved sensor means which includes a sensor (not shown) fixed to the housing 21 and an actuator (not shown) fixed to the cassette 1 or 2 to identify the type of sheets received in either of the cassette 1 or 2. The actuator is manually displaceable to change the sensing signal which is indicative of the sheet type received in the cassette. As a result, each cassette is capable of receiving sheets of different sheet types, thus enhancing the usefulness of the cassettes.

A signal processor for processing a signal generated by the above-described sensor is also provided. Furthermore, a manual feed passage 44*a* is disposed on the wall of the housing 21 at the F side. The manual feed passage 44*a* is positioned facing the feed roller pair 45. A sheet, if so required, can be fed manually through the manual feed passage 44*a*, thus avoiding the cassettes 1 and 2.

Figure 4:
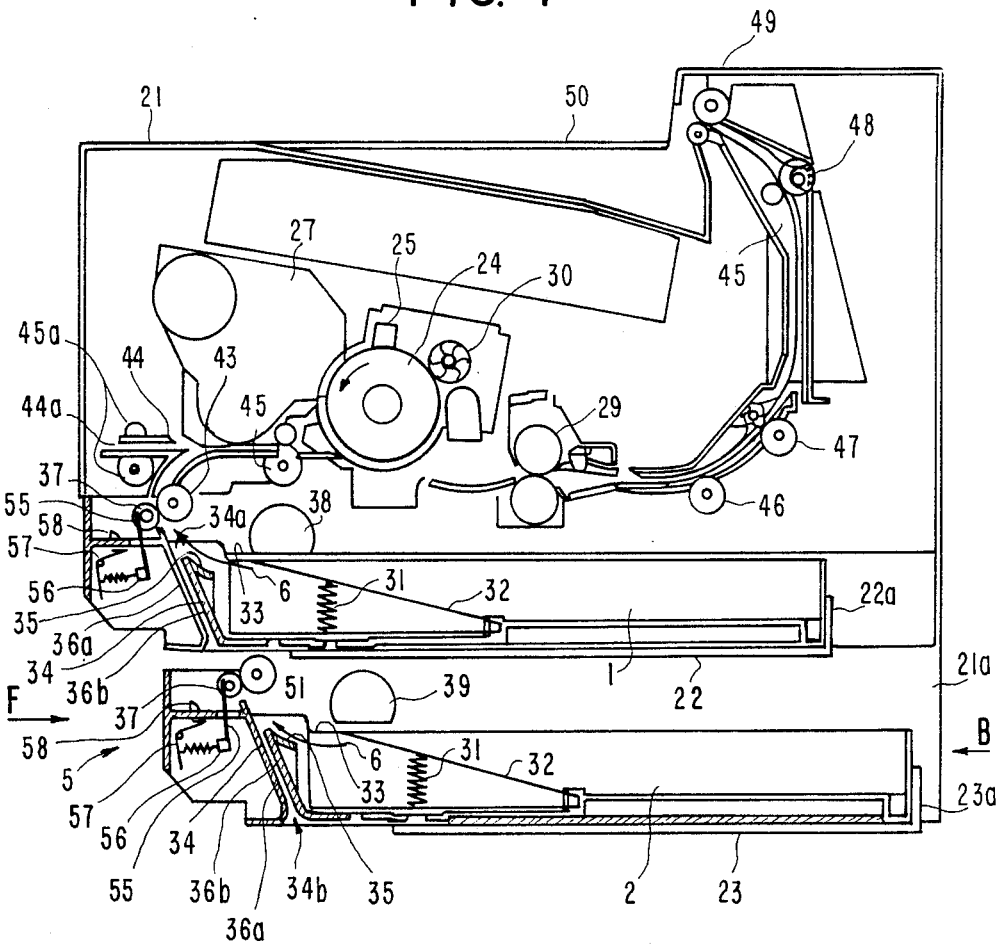
FIG. 4 is a cross-sectional side view of a recording apparatus of a preferred embodiment according to the present invention.

FIG. 4 is a cross-sectional side view of a recording apparatus of a first preferred embodiment according to the present invention. The apparatus is an electrophotographic type machine having a photoconductive drum 24, a pre-charger 25 juxtaposed to the drum 24, an optical system 26 disposed in an upper portion of the recording apparatus, an image developer 27, an image transfer device 28, an image fixer 29, and a cleaner 30 in contact with the drum 24. These elements are generally known, and do not form a part of the present invention.

An apparatus housing 21 contains the above members therein. A sheet feed device 5 of the present invention is disposed in a lower portion 21*a* of the apparatus housing 21. Two cassettes 1 and 2 are disposed inside the lower portion 21*a*, and are stacked one above another and supported by accommodating shelves 22 and 23 which are horizontally disposed inside the lower portion 21*a* of the apparatus housing 21. On the frame of the apparatus housing 21, there are provided separating rollers 38 and 39 having segmental cross-sections and drive rollers 43 and 51. The drive rollers 43 and 51 form feed roller pairs respectively in combination with follower rollers 37 mounted on the cassettes 1 and 2 when the cassettes are set in the normal position.

Figure 2:
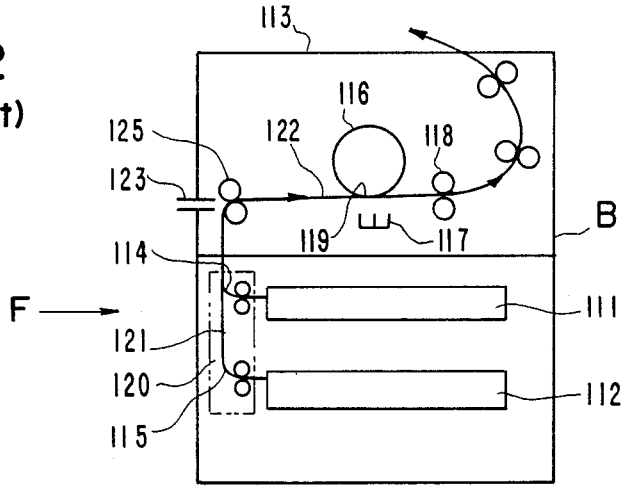
FIG. 2 (Prior Art)
FIG. 2 is a schematic diagram of another known sheet feed device.

Furthermore, similar to the known recording apparatus of FIG. 2, a manual sheet feed passage 44*a* and a corresponding pair of sheet feed rollers 45*a* are disposed on the front or "F" side of the housing 21. A sheet, if required, is fed through the passage 44*a* by hand.

Figure 5:
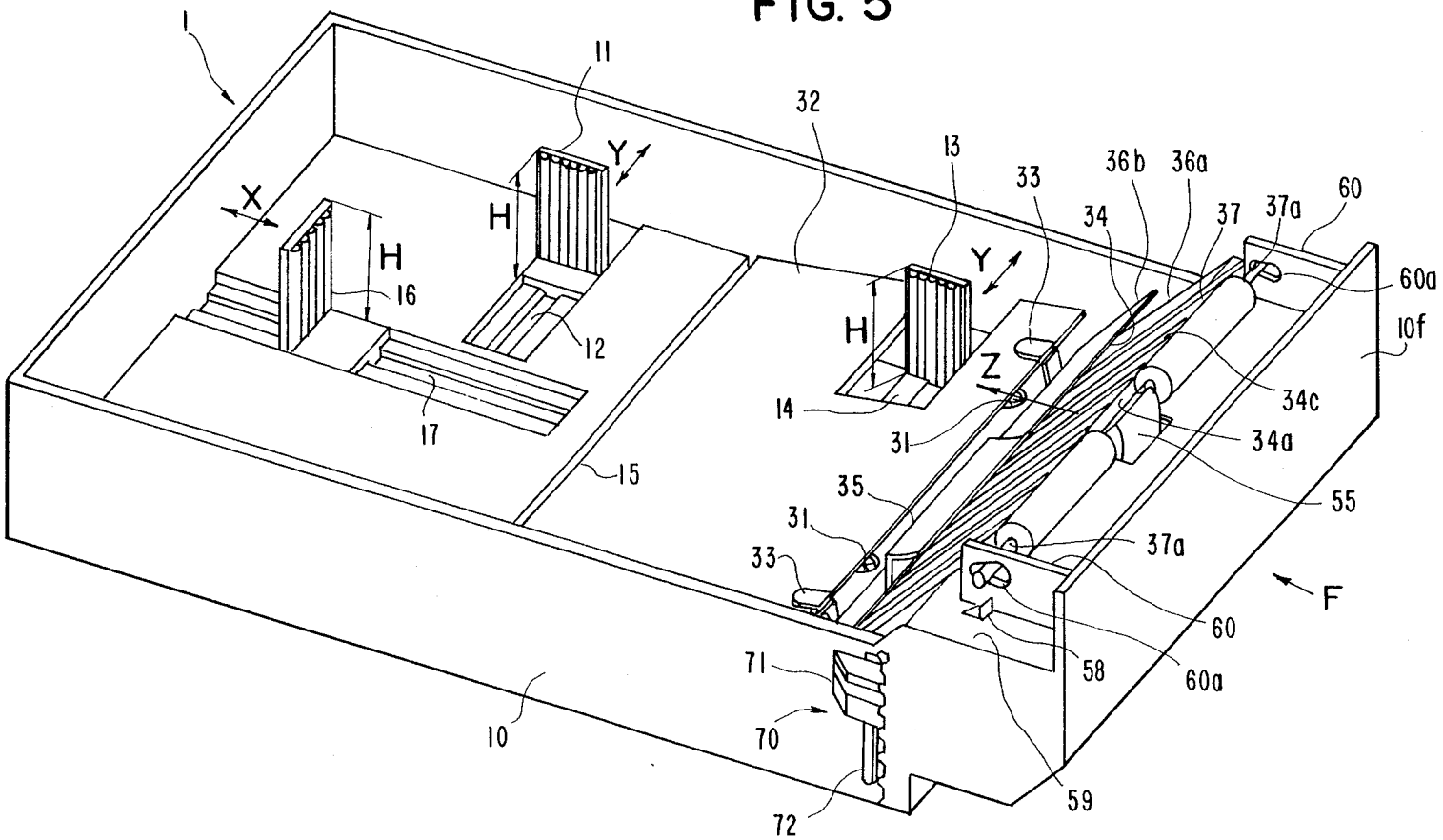
FIG. 5 is a perspective view of the cassette of FIG. 4.

The structure of the cassette 1 is described in more detail by referring now to the perspective view of FIG. 5. The cassette 1 has a frame box 10 which is adapted to fit on the accommodating shelf 22 when in the normal position. The normal position is maintained by locking means which includes a lock finger 58 disposed on the upper portion of the cassette 1. The front side of the cassettes 1 and 2, the sheet feed means 5, and the recording apparatus, are all defined as a side where the sheets are discharged from the cassettes 1 and 2. In the present invention, these above-described front sides are all advantageously coincident and designated by the reference letter F in the drawings.

In the cassette 1, a receiving plate 32 is pivotally mounted at 15 in the middle portion of the bottom of the frame box 10. Coil springs 31 bias the receiving plate 32 upwardly at the forward end thereof. Guides 11 and 13 having upstanding walls are movably mounted on the bottom floor of the frame box 10 through slidable members 12 and 14 respectively, and are slidable in a lateral direction indicated by directional arrows Y. Another guide 16 is mounted in a similar manner by means of a slidable member 17, and is slidable in a longitudinal direction indicated by a directional arrow X. A front half portion of the sheets (not shown) stacked in alignment in the cassette 1, is placed on the receiving plate 32. The horizontal position of the stacked sheets is restricted by the guides 11 and 13 contacting with one of the longitudinal side edges of the sheets, and by the guide 16 contacting the rear edges of the sheets. The position of each of the guides 11, 13 and 16 is adjustably fixed in advance depending on the size of the sheets to be received by means of the respective slidable members 12, 14 and 17. A pair of separate hook members 33 are disposed adjacent to the leading front edge of the receiving plate 32 for hooking the leading front edge of the stacked sheets from the top side.

Sheet jamming is an undesirable problem peculiar to a sheet feed device. One of the causes thereof is an excessive separating pressure exerted onto the stacked sheets by rotation of either separating roller 38 or 39. This can be caused by an overloading of sheets which excessively compresses the coil springs 31 disposed below the receiving plate 32, to a dead point, allowing no further compression thereof. To avoid overloading of the sheets, the height H of the guide 11, 13, and 16 is selected to limit the height of the stacked sheets to an appropriate height sufficient to eliminate the overloading of the sheets.

At the front side 10*f* of the box frame 10, a sheet feed means includes a sub-passage 34 (a through-passage), a guide plate 35, a follower roller 37 and a platform 59 formed at the front of the frame box 10. The sub-passage 34 is defined by passage side walls 36*a* and 36*b* which ar disposed on a slant and pass through the cassette 1. An outlet 34*a* is provided on the top of cassette 1 and an inlet 34*b* on the bottom, so that the passage side wall 36*a* extends from the bottom to the top of the cassette 1. The passage side wall 36*b* is shorter than the side wall 36*a*, and faces the lower portion of the side wall 36*a*. As the result, the sub-passage 34 has an open side portion 34*c* (refer also to FIG. 6) in the upper portion thereof where the side wall 36*b* does not exist. The open side portion 34*c* is located in line with a curved guide surface of the guide plate 35. The upper edge of the guide plate 35 is placed adjacent to the front edge of the receiving plate 32 and also parallel to the edge.

The follower roller 37 is located just above the outlet 34*a* of the sub-passage 34, and is rotatably mounted on a horizontal shaft 37*a* which is mounted on idle holes 60*a* provided in supporting plates 60 upstanding from opposite sides of the platform 59. The follower rollers 37 are resiliently pressed in a direction indicated by an arrow Z by a spring plate 55. The lower end of the spring plate 55 is secured to a base portion 56 of the frame box 10 which is schematically shown in FIG. 4 by a hatched square. The cassette 1 also has the locking members including vertically slidable lock fingers 58 disposed on the platform 59. Also, a pair of signal actuator units 70 (FIG. 5) are disposed on opposite sides of the cassette 1 and are mounted in slots 72 and include cam portion 71 slidably displaceable along the slot 72. The signal actuator units 70 will be described in more detail later.

Figure 6:
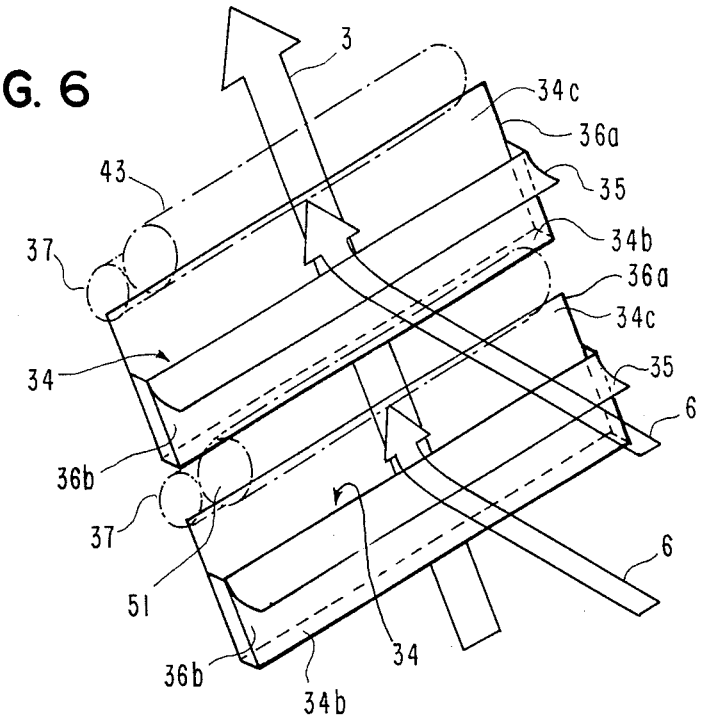
FIG. 6 is a schematic perspective view of a composite passage of the FIG. 5 embodiment, illustrating the spatial relation of the sub-passages and the individual passages of the cassettes.

FIG. 6 is a schematic perspective view of a composite common passage illustrating the spatial relation of the sub-passages 34 and the individual passages 6 of each of the cassettes 1 and 2. When both cassettes 1 and 2 are received, as shown in FIG. 4, in the accommodating shelves 22 and 23 respectively, and set in the normal position, the composite common sheet passage is made of sub-passages 34, both of which are disposed in alignment. As seen, each of individual passages 6 converges with the composite common passage at the relevant side open portion 34c of each subpassage 34. The sheet is advanced by roller pairs made of the rollers 37 and 43, or rollers 37 and 51. Of course, the composite common passage is broken up by pulling the cassette 1 or 2 outwardly off the accommodating shelves 22 or 23 from the front side F.

Thus, the sub-passage 34 of the lower cassette 2 is actually unnecessary because no sheet is transferred from a cassette disposed therebelow. However, the same structure of both cassettes 1 and 2 provides users with a favorable benefit of allowing exchangeability of the cassettes, and makes the production cost of the recording apparatus lower. The above-described configuration of the stacked two cassettes is also applicable to a sheet feed device having three or more cassettes.

Figure 7:
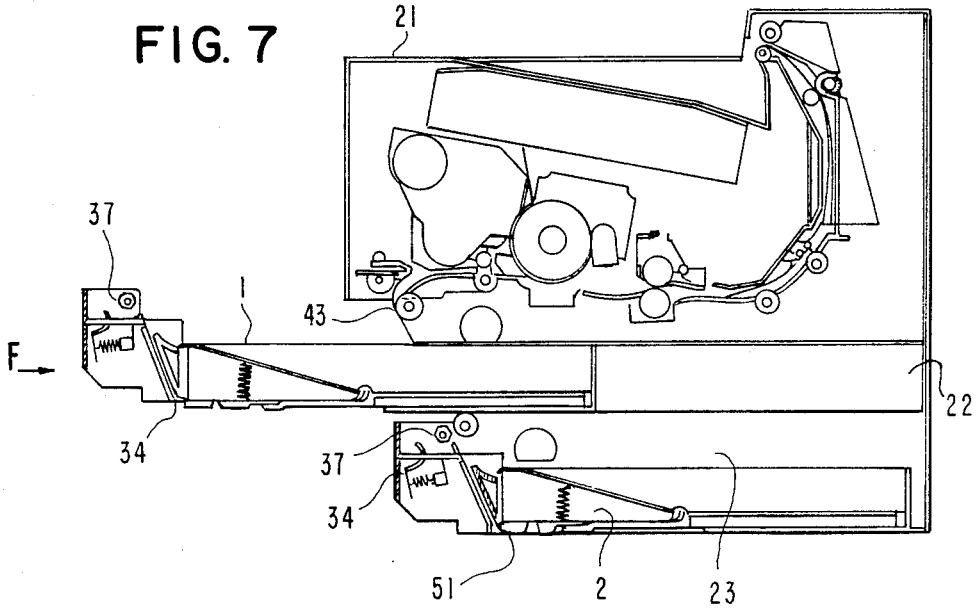
FIG. 7 is a cross-sectional view of the FIG. 4 embodiment, illustrating the cassette set in a normal position, with one cassette drawn out to disrupt the composite passage.

FIG. 7 is a cross-sectional view of the apparatus illustrating the cassette 2 set in the normal position and the cassette 1 in a drawn out position. Cassette 1 may be pushed into the accommodating shelf 22 and locked into the normal position. As the result, the sub-passages 34 are aligned to form the composite common passage, and the follower rollers 37 are respectively pressed against the feed rollers 43 and 51 forming contact portions therebetween. The apparatus is then ready for feeding a sheet from either of cassettes 1 and 2.

Operation of the sheet feed device 5 is described briefly referring to FIGS. 4, 5 and 6. Except for the constitution of the sheet feed passages, the function is similar to that of a conventional one. A plurality of recording sheets of a particular sheet type having the same dimensions and the same sheet quality are received in one of the cassettes 1 or 2. The sheets are stacked in alignment by the aid of the guides 11, 13, and 16 to form a stack (not shown). A leading half portion of the stack is received on the receiving plate 32, which is subjected to an upwardly directed force due to the upward bias generated by the coil springs 31. The leading edge of the uppermost sheet of the stack is hooked by the separate hook members 33. Sheets of perhaps a different sheet type, which are received in the cassette 2, are left as they are.

The separating roller 38 is selectively controlled by a printing controller (not shown). When the separating roller 38 is actuated, the uppermost sheet of the stack is separated in a well-known manner, escaping from the hooking of the separate hook members 33, advancing forwardly along the individual passage 6 defined by the surface of the guide plate 35, and entering the contact portion between the rollers 37 and 43 through the side opened portion 34c. The sheet is then forwardly transferred into the common sheet passage 3 before being finally discharged from the outlet 34a of the uppermost cassette 1 and sent into an introducing passage 44. In the above case, the separating roller 39 is selectively disengaged under the control of the printing controller, during engagement of separating roller 38. Each of the separating rollers 38 and 39 has a positive disk clutch (not shown) which includes a driving member and a driven member. The driving members of both clutches are simultaneously driven by a commonly engaged drive belt (not shown) according to a time schedule of sheet feeding, and the driven members are fixed to a shaft and another shaft (not shown) of the separating rollers 38 and 39 at each of the opposite ends of the shaft. Either separating roller 38 or 39 is selectively rotated by selectively engaging the relevant clutch and selectively disengaging the other clutch.

Figure 1:
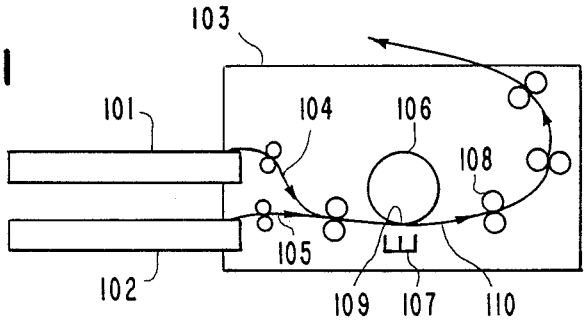
FIG. 1 (Prior Art)
FIG. 1 is a schematic diagram of a known sheet feed device.

Sheet jamming in a recording apparatus tends to occur in the vicinity of a sheet discharge outlet of the relevant sheet feed device. In the present invention, the cassettes 1 and 2 are allowed to be drawn from the side F of the apparatus housing 21. As seen from the drawings, the side F is adjacent to the discharge outlet 34a of the common passage 3. As a result, jammed sheet disposal can be performed by drawing out the cassettes 1 and/or 2. Thus, opening of the apparatus housing 21 is not necessary. In addition, as described above, a sheet can be fed manually by the operator through the manual feed passage 44a which is disposed on the F side of the housing 21. Thus, from the F side of the apparatus, the operator can load or unload sheets in the cassettes, feed a sheet manually, and dispose of jammed sheets, if necessary. No further space is required for operating the recording apparatus, such as a space on the B side of the apparatus; thus, a space saving feature is realized. This represents a distinct advantage of the present invention as compared to known sheet feed devices such as those of FIG. 1 and FIG. 2.

Next, sensor means which includes the signal actuator unit 70 shown in FIG. 5 and a sensor cooperatively paired therewith is described with reference to FIG. 8. The signal actuator unit 70 is disposed in a forward portion of a side wall 10a of the frame box 10 of the cassette 1. The sensor 90 is secured to the frame member 4 of the feed device 5 (not shown in FIG. 8).

Figure 8:
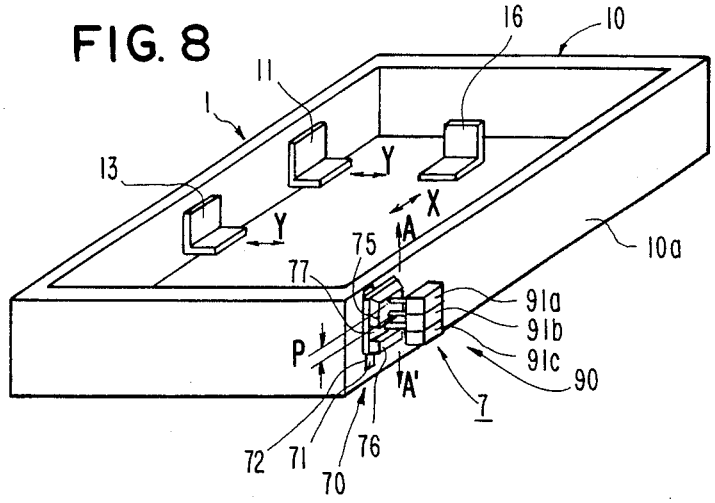
FIG. 8 is a substantially schematic perspective view of a cassette illustrating a positional relationship between a signal actuator unit and a sensor according to the present invention.

FIG. 8 is a substantially schematic perspective view of the cassette 1 illustrating the mutual positional relation between the signal actuator unit 70 and a sensor 90. The signal actuator unit 70 is laterally movable relative to the cassette 1 as indicated by arrows A and A'. The sensor 90 is composed of three microswitches 91a, 91b, and 91c, being disposed side by side in the direction A—A', which are mounted adjacent the signal actuator unit 70. Each microswitch has a single actuating button which is movable in and out of the microswitches for switching the microswitches ON or OFF. The buttons are positioned in a line to be separated from each other by a predetermined distance or pitch p.

The signal actuator unit 70 includes a cam portion 71 and is mounted in a slot 72 (shown in FIG. 5). The cam portion 71 has upwardly projecting portions 75 and 76, and a recessed portion 77, and is manually movable along the slot 72 in steps at distances equal to the pitch p. As a result, the position of the signal actuator unit 70 can be changed by multiples of the pitch p. In contrast, the position of the sensor 90 is fixed. The relative position between the signal actuator unit 70 and the sensor 90, therefore, can be varied by a multiple of the pitch of the arrangement of the microswitches 91a to 91c. Thus, the signal pattern outputted from the sensor 90 is variably selectable corresponding to the type of the sheets received in the relevant cassette 1, by displacing the cam portion 71 in the direction A—A' by a multiple of the pitch p. Thus, button depression or extension (which determines the ON/OFF status of the microswitches) is determined by the adjusted position of the actuator unit 70.

Figure 9:
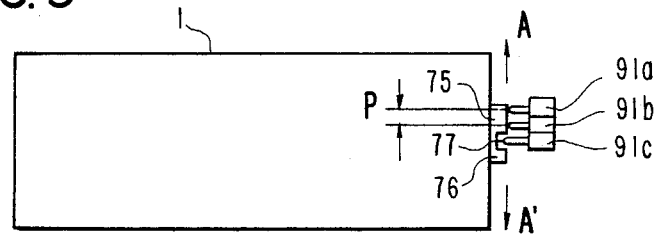
FIG. 9 is a schematic front view of a cassette illustrating a relative positional relationship between the sensor and the signal actuator unit of FIG. 8.

FIG. 9 is a schematic front view of the cassette 1 illustrating a positional relationship between the sensor 90 and the signal actuator unit 70. When the cassette 1 is set in the normal position, the sensor 90 and the signal actuator unit 70 are in an engaging position. A microswitch engaging one of the projected portions 75 and 76 is made ON, and a microswitch engaging the recessed portion 77 is made OFF.

Figures 10A, 10B, 10C:
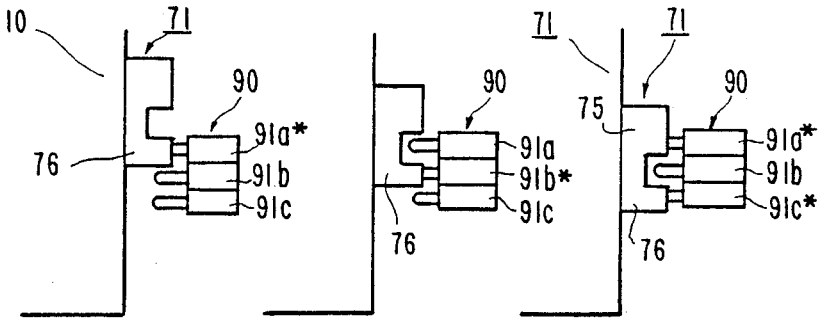
FIGS. 10(*a*) through 10(*f*) are schematic diagrams illustrating the positional relationship between the sensor and the signal actuator unit of FIG. 8 for various positions of the signal actuator unit thus creating various signals.
Figure 10D:
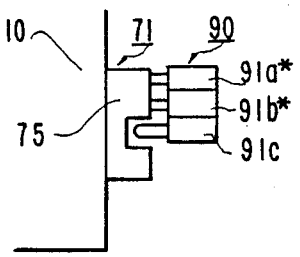
Figure 10:
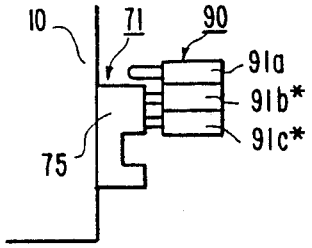
Figure 10F:
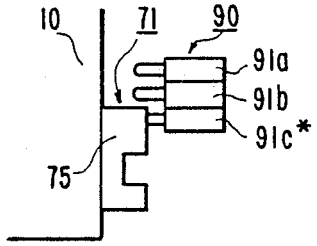

FIGS. 10(*a*) to 10(*f*) are diagrams illustrating the positional relationship between the sensor 90 and the signal actuator unit 70 for various positions of the signal actuator unit 70 which is manually displaced and set in a desired position by an operator. The sensing means 7 of the embodiment is capable providing six sheet types with respective eight different signal patterns (three microswitches multiplied by two possible positions) which indicate eight three bits digital signals. These digital signal patterns are transferred to a signal identity processor (not shown) which employs three connecting wires per cassette. The processor identifies the signals and sends them to the printing controller to control the relevant devices such as the separating rollers 38 and 39.

With the above-described configuration of the signal actuator unit 70, the operator can set by hand a signal pattern to the cassette 1 corresponding to the type of sheets received in the cassette 1. The number of the sheet types is up to eight, thus increasing the uses of the cassette 1. Of course, this advantage is also available with respect to the cassette 2.

Figure 11:
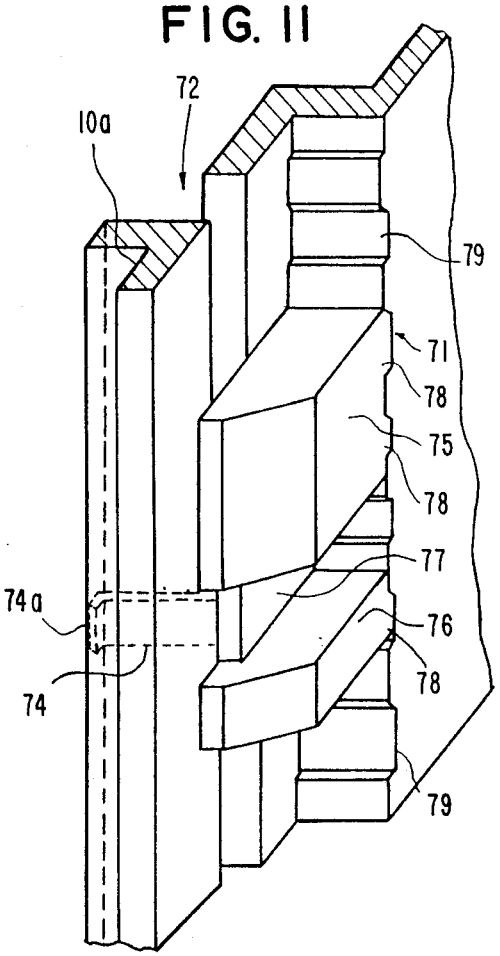
FIG. 11 is an enlarged perspective view, partly in section, of the signal actuator unit shown in FIGS. 5 and 8.

FIG. 11 is a magnified perspective view of the signal actuator unit 70 shown in FIG. 5. A body has a cam portion 71. Both the body and the side wall 10*a* of the frame box 10 are made of plastic material. The slot 72 opens into the side wall 10*a* in the direction A—A′ as shown in FIG. 8. A back side rack 79 has a plurality of parallel grooves 77 which run in the direction A—A′ and are spaced apart at a distance equal to the pitch p. The body includes a resilient plastic finger 74 extending in a direction perpendicular to the major surface of the side wall 10*a* through the slot 72. The finger 74 has a hook member 74*a* at the tip which engages an inner surface of the side wall 10*a*. Due to the hook 74*a*, the body which includes the cam portion 71 is spring biased against the side wall 10*a*. The body further has protruding portions 78 on the back side of the projecting portions 75 and 76, the protruding portions 78 being adapted to mesh with and thereby engage the grooves of the rack 79. With such a structure, the cam portion 71 is movable in steps at the pitch p by hand up and down in the direction A—A′.

Figures 12, 13:
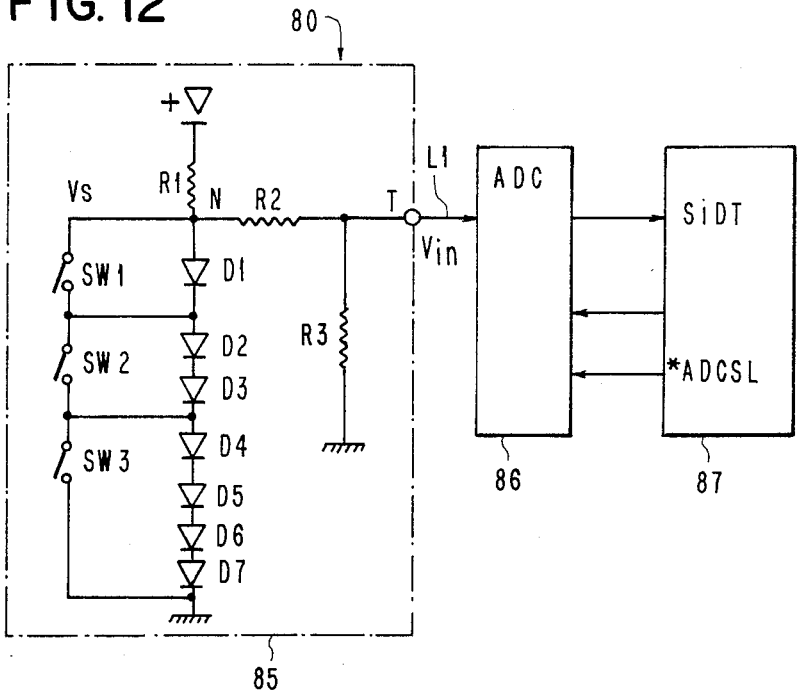
FIG. 12 is a wiring diagram of an improved signal processor according to the present invention.
FIG. 13 is a table numerically representing the relationship between ON and OFF states of the microswitch analog signal voltages and digital signal voltages shown in FIG. 12.

There is provided herein an alternative system for processing digital signals provided by the sensor 90 in combination with the signal actuator unit 70. In the above-described embodiment, three bit digital signals are sent to the printing controller through three connecting wires per cassette. In order to reduce the number of such connecting wires, an improved signal processor 80 is provided, a wiring diagram of which is shown in FIG. 12. The microswitches 91*a*, 91*b*, and 91*c*, respectively designated as SW1, SW2, and SW3, are connected in series to the ground and a voltage source V (+5V) through a series resistor R1. The signal processor 80 includes a detector 85, an AD converter (ADC) 86, and a printing controller 87. The detector 85 includes a diode D1 connected to the microswitch 91*a* in parallel, two pieces of diodes D2, D3 mutually connected in series and connected to the microswitch 91*b* in parallel, four pieces of diodes D4, D5, D6 and D7 connected in series which is connected to the microswitch 91*c* in parallel. The voltage source V, the resistor R1, and the diodes D1 to D7 are connected in series in said order and grounded. These diodes D1 to D7 act as voltage dividing means. The node N between the resistor R1 and the diode D1 is connected to an output terminal T represented by a small circle through a resistor R2. The terminal is grounded through a resistor R3, and the signal voltage Vin at the terminal T is applied to the AC/DC converter 86 through a single wiring line L1. The combination of ON and OFF states of microswitches 91*a*, 91*b*, and 91*c* varies the voltage Vs at the node N in steps. The voltage Vs is reduced to the voltage Vin by the ratio of R3/(R2+R3). The voltage Vin provides an analog signal which is converted into an eight bit digital signals SiDT through the AD converter 86 under synchronization with clock signals and *ADCSL signals sent from the printing controller 87. Then, the digital signals SiDT are fed to the printing controller 87. Under the assumption that R2=R3, a voltage drop in each of the diodes is 0.7 V. The relationship between the ON and OFF states of the microswitches 91*a*, 91*b*, and 91*c*, the analog signal voltages Vs and Vin, and the digital signal voltages SiDT, are numerically represented in FIG. 13.

Figure 14:
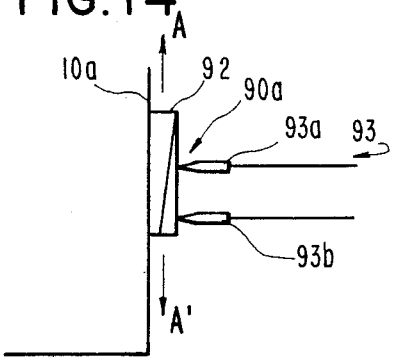
FIG. 14 is a schematic cross-sectional front view of an alternative embodiment of a sensor according to the present invention.

FIG. 14 is a schematic cross-sectional front view of a modified sensor means 90*a* which includes a signal actuator unit 92 and a sensor 93 (an electrical resistance measuring instrument) having two parallel terminals 93*a* and 93*b*. The signal actuator unit 92 is a resistor having a linearly varying resistance in the direction A or A′ shown by two arrows in FIG. 14. The distribution of the resistance is linear and shown schematically by a diagonal line through the actuator unit 92. The signal actuator unit 92 is displaceable in the direction A—A′ by hand, while the location of the sensor 93 is fixed.

Figure 15A:
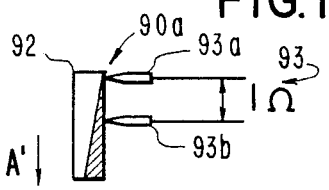
FIG. 15(*a*) and FIG. 15(*b*) are schematic front views of the sensor of FIG. 14.
Figure 15B:
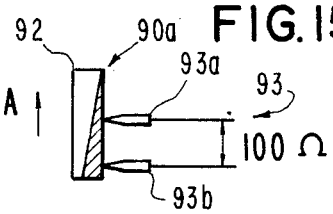

FIGS. 15(*a*) and 15(*b*) are schematic front views of the sensor means 90*a*. When the signal actuator unit 92 is lowered in the direction A′, as shown in FIG. 15(*a*), the detected resistance is low (1 Ohm, for instance) and when elevated in the direction A, as shown in FIG. 15(*b*), the detected resistance is high (100 Ohms, for instance). The signal of the detected resistance is analog, and processed in the similar manner to the signal Vin of the preceding case. Other sensing means employing other elements, such as a pair of optical sensors and a displaceable black and white pattern, can be used.

In the above description, a recording apparatus having two cassettes or sheet holding means in the lower portion of the apparatus housing has been described. The present invention in its various embodiments is also applicable to a recording apparatus having more than two cassettes, such as five cassettes.

Figure 16:
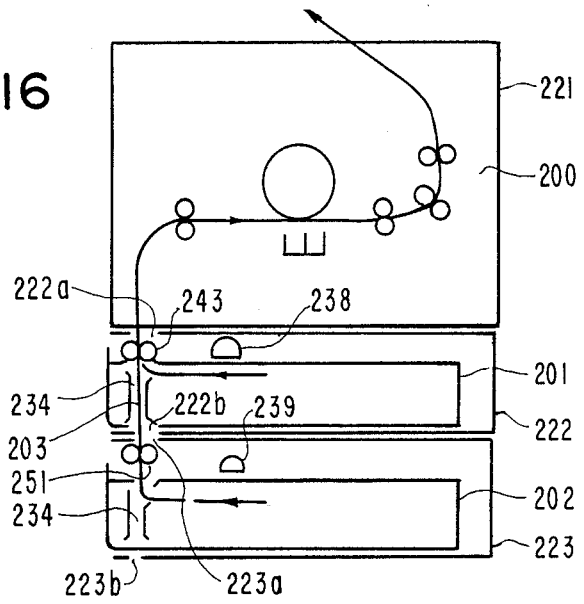
FIG. 16 is a schematic cross-sectional side view of a recording apparatus having cassettes according to the present invention, each accommodated in a corresponding cassette housing.

In order to increase the benefit of the exchangeability of the cassettes for users, as described above, an improved structure of the housing is proposed. FIG. 16 is a schematic cross-sectional side view of the recording apparatus illustrating such a structure.

The apparatus housing 221 is limited to hold and enclose the elements of the apparatus except for elements of the sheet feed device. Thus, the housing 221 houses only a recording device 200 of the apparatus. Each cassette 201 and 202 is individually accommodated in each cassette housing 222 and 223 respectively. The cassette housings 222 and 223 are constructed for steady stacking one on top of another. The mechanical strength of the cassettes is sufficient to hold the recording device 200 of the apparatus in a stacked disposition on top of the pile of stacked cassette housings 222 and 223.

The cassettes 201 and 202 have the same basic structure as that of the cassettes 1 and 2 shown in FIGS. 4 and 5. Each cassette has a sub-passage (a through passage) 234, and each cassette housing 222 and 223 has an upper hole 222*a* and 223*a* and a lower hole 222*b* and 223*b*, respectively, corresponding to the outlet and inlet of the relevant sub-passage 234. With this configuration, sheets held in the cassettes are fed through a composite common sheet feed passage 203 composed of the sub-passages 234. Of course, the relevant feed rollers 243 and 251, and separate rollers 238 and 239 are disposed in each cassette housing 222 and 223 so as to be driven under control of control means (not shown) of the apparatus. Thus, the user of the recording apparatus can increase or decrease the number of cassettes depending on individual requirements.

Figure 17:
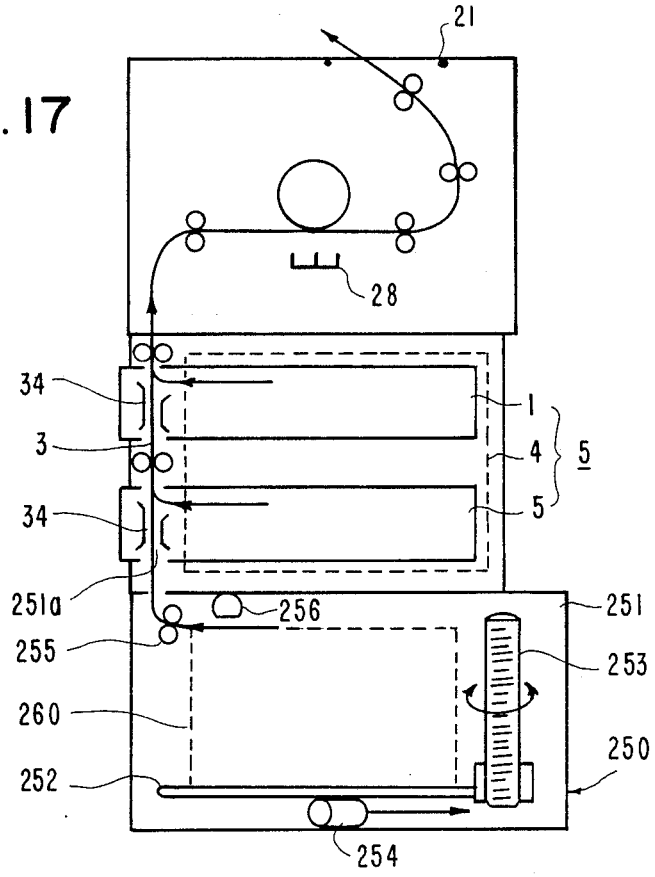
FIG. 17 is a schematic cross-sectional side view of an alternative embodiment of a recording apparatus which includes a sheet hopper at the bottom of the apparatus.

FIG. 17 is a substantially schematic view of a recording apparatus illustrating one example of another embodiment of the structure of the cassette according to the present invention. In operation of a recording apparatus, there frequently occurs a case where vast amounts of recording sheets of one type are required while small amounts of sheets of other types are also occasionally necessary. According to the present invention, the former is held in holding means having a high volume capacity, such as a sheet holding hopper 250, which is separate from the cassettes. As shown in FIG. 17, the sheet hopper 250 is disposed under the recording apparatus. The sheet hopper 250 includes a horizontal hopper table 252, a rotatable spindle 253 having screw threads, a driving motor 254, a pair of feed rollers 255, a separate roller 256, and a housing 251 Which close and hold the above elements. A sheet pile 260 having a vast quantity of sheets of one type is stacked in alignment on the hopper table 252. The sheet pile 260 moves vertically upwardly and downwardly by rotation of the spindle when driven by the motor 254. The motor 254 is under control of a sensor system (not shown) for sensing the position of the uppermost sheet of the sheet pile 260. An uppermost one of the sheets is separated by the separate roller 256 and fed by the pair of feed rollers 255 toward the sheet discharge outlet 251*a* in a conventional manner. The separate roller 256 and the pair of sheet feed rollers 255 are under control of a printing controller (not shown). Thus, the sheet discharge outlet 251*a* of the sheet hopper 250 must be disposed in alignment with the common sheet feed passage 3 as the sheets stacked in the sheet pile 260 are fed into the common passage 3 one by one and further conveyed to an image transfer station 28 of the apparatus.

Although the invention has been described with respect to particular illustrative embodiments, it will be understood that variations and modifications may be made within the true spirit and scope of the present invention.

What we claim is:

1. A sheet feed apparatus for a recording machine which records an image on a sheet, comprising:

a plurality of sheet holding means, stackable one above the other, each having a top and bottom and holding a plurality of sheets stacked in a pile therein;

support means for supporting said plurality of sheet holding means alternatively at a predetermined normal position and in a forwardly drawing position; and each of said holding means including a sheet feed passage within each sheet holding means for passing sheets fed from said pile of said sheets, and converging with a sheet fed sub-passage provided at a forward end of said sheet holding means and passing from the bottom to the top of said sheet holding means, all of said feed sub-passages being aligned to form a substantially linear common sheet feed passage when all of said plurality of sheet holding means are set at said normal position in said supporting means, said common sheet feed passage passing said sheets fed from any of said sheet feed sub-passages, and wherein each of said sheet holding means includes a first passage side wall extending from the bottom to the top of said sheet holding means, a second passage side wall having a shorter length than that of said first passage side wall in an advancing direction of said sheet and being substantially parallel to and facing a lower portion of said first passage side wall, said first passage side wall and said second passage side wall forming said sheet feed sub-passage having an inlet at the bottom, an opened side portion in an upper portion thereof, and an outlet at a top portion of said first passage side wall.

2. A sheet feed apparatus according to claim 1, wherein each of said sheet holding means includes a guide plate forming said sheet feed passage, for guiding said sheets fed one by one from said pile of said sheets held in said sheet holding means to said common sheet feed passage.

3. A sheet feed apparatus according to claim 1, further comprising frame means disposed within the housing, and a pair of feed rollers corresponding to each of said sheet holding means, each pair of feed rollers including a drive roller and a follower roller for advancing sheets, and being disposed above said outlet of said sheet feed sub-passage of each sheet holding means, each drive roller being disposed on said frame means, and each follower roller being disposed in a corresponding one of said sheet holding means, said drive roller and said follower roller being disposed such that both rollers are pressed together when said corresponding sheet holding means is in the normal position, each said sheet held in said sheet holding means being fed one by one to said pair of feed rollers through said sheet feed passage, and then advancing by said sheet feed rollers toward the outlet of the uppermost sheet holding means.

4. A sheet feed apparatus according to claim 1, further comprising sensor means associated with each sheet holding means for sensing the type of said sheets held in said housing means.

5. A sheet feed apparatus according to claim 4, wherein said sensor means comprises, a signal actuator unit displaceably disposed on each said sheet holding means, and a sensor, corresponding to each signal actuation unit, secured to said supporting means in proximity to each said signal actuator unit so that said sensor cooperates with said actuator unit to output a signal, said signal being variable in relation to the sheet type of said sheets held in said sheet holding means in response to the displacement of said signal actuator unit.

6. A sheet feed apparatus according to claim 5, wherein each said signal actuator unit is mounted in a slot formed in a side wall of said sheet holding means, and includes a cam surface portion for actuating the sensor and a rack portion for positionally fixing the actuator unit in the slot.

7. A sheet feed apparatus according to claim 6, wherein said sensor comprises a plurality of microswitches disposed side-by-side, each of said microswitches having a movable actuating button, all of said actuating buttons being positioned in alignment with each other and spaced apart by a predetermined distance, said actuator unit actuating said microswitches which output a variety of combinations of ON and OFF digital signals, each combination being indicative of a type of sheet holding means.

8. A sheet feed apparatus according to claim 5, wherein said signal actuator unit is a resistor adjustably mounted on said sheet holding means, said resistor having a resistance which varies linearly along its length, and said sensor has two parallel measuring terminals which contact said resistor and measure the resistance between said two measuring terminals.

9. A sheet feed apparatus according to claim 7, further comprising a signal processing system for processing said digital signals.

10. A sheet feed apparatus according to claim 9, wherein said signal processing means includes signal generator means for generating an analog signal based on said combination of outputs of ON and OFF signals of said microswitches, an analog to digital converter for receiving said analog signal generated in said signal generator, and converting said analog signal to a digital signal, and means for identifying a type of sheet holding means based on said digital signal.

11. A recording apparatus for recording an image on a sheet comprising:

a housing having a pair of side walls facing each other;

a plurality of pairs of rails disposed along said pair of side walls of said housing, said rails being stacked and spaced apart from each other;

a plurality of sheet holding means, each of which has a top and a bottom and holds a plurality of sheets and is movable between a normal position and a forwardly drawn position, and supported by a corresponding pair of said rails, each sheet holding means being stacked one above another and spaced in close proximity to each other;

a pair of feed rollers for each sheet holding means and including a follower roller disposed on a forward upper end of each sheet holding means and a drive roller mounted in the housing; and a sheet discharge outlet for discharging said sheets one by one therethrough, and being disposed at an upper portion of each said sheet holding means, and each of said sheet holding means including:

a first guide path passing through said sheet holding means from the bottom to the top of said sheet holding means;

a second guide path guiding each sheet fed from said sheet holding means, and guiding said sheet to be transferred into said first guide path; and the first guide paths of said sheet holding means collectively forming a common substantially linear guide path passing through said plurality of sheet holding means when all said sheet holding means are in the normal position.

12. A sheet feed apparatus for a recording machine which records an image on a sheet, comprising:

a plurality of sheet holding means, stackable one above the other, each having a top and bottom and holding a plurality of sheets stacked in a pile therein;

support means for supporting said plurality of sheet holding means alternatively at a predetermined normal position and in a forwardly drawn position;

each of said sheet holding means including a sheet feed passage within each sheet holding means for passing sheets fed from said pile of said sheets, a sheet feed sub-passage penetrating said sheet holding means from the bottom to the top of said sheet holding means;

all of said feed sub-passages being aligned to form a common sheet feed passage when all of said plurality of sheet holding means are set at said normal position in said supporting means, said common sheet feed passage passing said sheets fed from any of said sheet feed sub-passages; and sensor means associated with each sheet holding means for sensing the type of said sheets held in said housing means, wherein said sensor means comprises, a signal actuator unit displaceably disposed on each said sheet holding means, and a sensor, corresponding to each signal actuation unit, secured to said supporting means in proximity to each said signal actuator unit so that said sensor cooperates with said actuator unit to output a signal, said signal being variable in relation to the sheet type of said sheets held in said sheet holding means in response to the displacement of said signal actuator unit, and wherein said signal actuator unit is a resistor adjustably mounted on said sheet holding means, said resistor having a resistance which varies linearly along its length, and said sensor has two parallel measuring terminals which contact said resistor and measure the resistance between said two measuring terminals.

13. A sheet feed apparatus according to claim 12, wherein each said signal actuator unit is mounted in a slot formed in a side wall of said sheet holding means, and includes a cam surface portion for actuating the sensor and a rack portion for positionally fixing the actuator unit in the slot.

14. A sheet feed apparatus according to claim 13, wherein said sensor comprises a plurality of microswitches disposed side-by-side, each of said microswitches having a movable actuating button, all of said actuating buttons being positioned in alignment with each other and spaced apart by a predetermined distance, said actuator unit actuating said microswitches which output a variety of combinations of ON and OFF digital signals, each combination being indicative of a type of sheet holding means.

15. A sheet feed apparatus according to claim 12, wherein each of said sheet holding means includes a guide plate forming said sheet feed passage, for guiding said sheets fed one by one from said pile of said sheets held in said sheet holding means to said common sheet feed passage.

16. A sheet feed apparatus according to claim 12, wherein each of said sheet holding means includes a first passage side wall extending from the bottom to the top of said sheet holding means, a second passage side wall having a shorter length than that of said first passage side wall in an advancing direction of said sheet and being substantially parallel to and facing a lower portion of said first passage side wall, both said first passage side wall and said second passage side wall forming said sheet feed sub-passage having an inlet at the bottom, an opened side portion in an upper portion thereof, and an outlet at a top portion of said first passage side wall.

17. A sheet feed apparatus according to claim 16, further comprising frame means disposed within the housing, and a pair of feed rollers corresponding to each of said sheet holding means, each pair of feed rollers including a drive roller and a follower roller for advancing sheets, and being disposed above said outlet of said sheet feed sub-passage of each sheet holding means, each drive roller being disposed on said frame means, and each follower roller being disposed in a corresponding one of said sheet holding means, said drive roller and said follower roller being disposed such that both rollers are pressed together when said corresponding sheet holding means is in the normal position, each said sheet held in said sheet holding means being fed one by one to said pair of feed rollers through said sheet feed passage, and then advancing by said sheet feed rollers toward the outlet of the uppermost sheet holding means.

18. A sheet feed apparatus for a recording machine which records an image on a sheet, comprising:

a plurality of sheet holding means, stackable one above the other, each having a top and bottom and holding a plurality of sheets stacked in a pile therein;

support means for supporting said plurality of sheet holding means alternatively at a predetermined normal position and in a forwardly drawn position;

each of said sheet holding means including a sheet feed passage within each sheet holding means for passing sheets fed from said pile of said sheets, a sheet feed sub-passage penetrating said sheet holding means from the bottom to the top of said sheet holding means;

all of said feed sub-passages being aligned to form a common sheet feed passage when all of said plurality of sheet holding means are set at said normal position in said supporting means, said common sheet feed passage passing said sheets fed from any of said sheet feed sub-passages, sensor means associated with each sheet holding means for sensing the type of said sheets held in said housing means, wherein said sensor means comprises, a signal actuator unit displaceably disposed on each said sheet holding means, and a sensor, corresponding to each signal actuation unit, secured to said supporting means in proximity to each said signal actuator unit so that said sensor cooperates with said actuator unit to output a signal, said signal being variable in relation to the sheet type of said sheets held in said sheet holding means in response to the displacement of said signal actuator unit, wherein each said signal actuator unit is mounted in a slot formed in a side wall of said sheet holding means, and includes a cam surface portion for actuating the sensor and a rack portion for positionally fixing the actuator unit in the slot, wherein said sensor comprises a plurality of microswitches disposed side-by-side, each of said microswitches having a movable actuating button, all of said actuating buttons being positioned in alignment with each other and spaced apart by a predetermined distance, said actuator unit actuating said microswitches which output a variety of combinations of ON and OFF digital signals, each combination being indicative of a type of sheet holding means, and a signal processing system for processing said digital signals, wherein said signal processing means includes signal generator means for generating an analog signal based on said combination of outputs of ON and OFF signals of said microswitches, an analog to digital converter for receiving said analog signal generated in said signal generator, and converting said analog signal to a digital signal, and means for identifying a type of sheet holding means based on said digital signal.

19. A sheet feed apparatus for a recording machine which records an image on a sheet, comprising:

a plurality of sheet holding means, stackable one above the other, each having a top and a bottom and a front outer wall holding a plurality of sheets stacked in a pile therein;

support means for supporting said plurality of sheet holding means alternatively at a predetermined normal position and in a forwardly drawn position;

each of said sheet holding means including a sheet feed passage within each sheet holding means for passing sheets fed from said pile of said sheets, a sheet feed sub-passage penetrating said sheet holding means from the bottom to the top of said sheet holding means;

all of said feed sub-passage being aligned to form a common sheet feed passage when all of said plurality of sheet holding means are set at said normal position in said supporting means, said common sheet feed passage passing said sheets fed from any of said sheet feed sub-passages being provided at a forward portion of each corresponding sheet holding means with respect to the direction in which said sheet holding means is drawn from said supporting means.

20. A sheet feed apparatus of claim 19, wherein said front outer wall of each of said plurality of said sheet holding means forms a part of an outer wall of said apparatus.

21. A recording apparatus for recording an image on a sheet comprising:

a housing having a pair of side walls facing each other;

a plurality of pairs of rails disposed along said pairs of side walls of said housing, said rails being vertically spaced apart from each other;

a plurality of sheet holding means, each of which has a front outer wall, a top and a bottom, and holds a plurality of sheets and is movable between a normal position and a forwardly drawn position, and supported by a corresponding pair of said rails, and each being stacked one above another and spaced in close proximity to each other; and a sheet discharge outlet for discharging said sheets one by one therethrough, and being disposed at an upper portion of each sheet holding means, and each of said sheet holding means including:

a first guide path passing through said sheet holding means from the bottom to the top of said sheet holding means;

a second guide path guiding each sheet fed from said sheet holding means, and guiding said sheet to be transferred into said first guide path; and each first guide path being disposed in each of said sheet holding means so as to collectively form a common guide path passing through said plurality of sheet holding means when all said sheet holding means are in the same normal position, said sheet feed passage and said sheet feed sub-passage being provided at a forward portion of said sheet holding means with respect to the direction in which said sheet holding means is drawn from said apparatus and said front outer wall of each of said plurality of said sheet holding means forms a part of an outer wall of said apparatus.

22. A sheet feed apparatus for a recording machine which records an image on a sheet, comprising:

a plurality of sheet holding means, stackable one above the other, each having a top and a bottom and a front outer wall holding a plurality of sheets stacked in a pile therein;

support means for supporting said plurality of sheet holding means alternatively at a predetermined normal position and in a forwardly drawn position;

each of said sheet holding means including a sheet feed passage within each sheet holding means for passing sheets fed from said pile of said sheets, and each except a lower most of said sheet holding means including a sheet feed sub-passage penetrating said sheet holding means from the bottom to the top of said sheet holding means;

all of said feed sub-passages being aligned to form a common sheet feed passage when all of said plurality of sheet holding means are set at said normal position in said supporting means, said common sheet feed passage passing said sheets fed from any of said sheet feed sub-passages being provided at a forward portion of each corresponding sheet holding means with respect to the direction in which said sheet holding means is drawn from said supporting means.

* * * * *